US009204682B2

(12) United States Patent
Grott et al.

(10) Patent No.: US 9,204,682 B2
(45) Date of Patent: Dec. 8, 2015

(54) GOLF SHOE OUTSOLE

(71) Applicant: Taylor Made Golf Company, Inc., Carlsbad, CA (US)

(72) Inventors: Marco Aurelio Grott, San Marcos, CA (US); Ernie Rustam, Oceanside, CA (US); Gerald Kuhtz, Nuremberg (DE); June Cate, Chula Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 309 days.

(21) Appl. No.: 13/863,959

(22) Filed: Apr. 16, 2013

(65) Prior Publication Data

US 2013/0333247 A1 Dec. 19, 2013

Related U.S. Application Data

(60) Provisional application No. 61/659,119, filed on Jun. 13, 2012.

(51) Int. Cl.

| | |
|---|---|
| ***A43B 5/00*** | (2006.01) |
| ***A43C 9/00*** | (2006.01) |
| ***A43B 13/12*** | (2006.01) |
| ***A43B 13/22*** | (2006.01) |

(52) U.S. Cl.

CPC ..... *A43B 5/001* (2013.01); *A43B 13/122* (2013.01); *A43B 13/223* (2013.01); *A43C 9/00* (2013.01)

(58) Field of Classification Search

CPC ..... A43B 5/00; A43B 5/001; A43B 5/02; A43C 1/00; A43C 9/00

USPC ..... 36/126–129, 134, 114, 102, 88, 91, 94

See application file for complete search history.

(56) References Cited

U.S. PATENT DOCUMENTS

| | | | | |
|---|---|---|---|---|
| D292,443 | S | 10/1987 | Ihlenburg | |
| D347,105 | S | 5/1994 | Johnson | |
| 5,371,957 | A | 12/1994 | Gaudio | |
| 5,628,129 | A * | 5/1997 | Kilgore et al. | 36/134 |
| D380,889 | S | 7/1997 | Earle | |
| D390,347 | S | 2/1998 | Bathum | |
| D390,349 | S | 2/1998 | Murai et al. | |
| D401,747 | S | 12/1998 | Cessor | |
| D406,689 | S | 3/1999 | Murcia | |
| 5,979,083 | A * | 11/1999 | Robinson et al. | 36/127 |
| 6,119,373 | A | 9/2000 | Gebhard et al. | |
| D440,749 | S | 4/2001 | Rogers | |
| 6,237,251 | B1 | 5/2001 | Litchfield et al. | |
| 6,289,611 | B1 * | 9/2001 | Patterson et al. | 36/127 |
| D475,509 | S | 6/2003 | Avar | |
| D495,479 | S | 9/2004 | McDowell | |
| D496,778 | S | 10/2004 | Le | |
| D507,097 | S | 7/2005 | Sonnergren | |
| D509,948 | S | 9/2005 | Robinson, Jr. et al. | |
| D515,290 | S | 2/2006 | Sonnergren | |
| D539,515 | S | 4/2007 | Robinson, Jr. et al. | |
| D543,679 | S | 6/2007 | Edwards | |

(Continued)

*Primary Examiner* — Marie Bays

(74) *Attorney, Agent, or Firm* — Klarquist Sparkman, LLP

(57) ABSTRACT

A golf shoe outsole comprises a thin, flexible base layer having many discrete platforms projecting downwardly from the base layer for providing traction elements. The platforms are separated by channels and open regions to allow the discrete platforms to readily flex relative to one another about the thin base layer, providing enhanced flexibility to the outsole and improved traction performance during a dynamic act such as a golf swing.

28 Claims, 9 Drawing Sheets

(56) References Cited

U.S. PATENT DOCUMENTS

| | | | | |
|---|---|---|---|---|
| D548,440 | S | 8/2007 | Ortley et al. | |
| D551,433 | S | 9/2007 | Loverin | |
| D560,885 | S | 2/2008 | Lane et al. | |
| D564,198 | S | 3/2008 | Kuhtz | |
| D567,490 | S | 4/2008 | Campbell et al. | |
| 7,392,604 | B2 | 7/2008 | Greene et al. | |
| D578,286 | S | 10/2008 | Hogan | |
| D580,136 | S | 11/2008 | St-Louis et al. | |
| D581,146 | S | 11/2008 | Lane, III | |
| D586,989 | S | 2/2009 | Dave et al. | |
| D587,441 | S | 3/2009 | Lane, III et al. | |
| D593,736 | S | 6/2009 | Mochen et al. | |
| D593,738 | S | 6/2009 | McClaskie | |
| D595,945 | S | 7/2009 | Mochen | |
| D601,785 | S | 10/2009 | Lane, III et al. | |
| 7,610,695 | B2 * | 11/2009 | Hay | 36/25 R |
| D607,635 | S | 1/2010 | Lane, III et al. | |
| D608,081 | S | 1/2010 | Bacon et al. | |
| D609,893 | S | 2/2010 | Kuhtz | |
| 7,685,745 | B2 | 3/2010 | Kuhtz et al. | |
| D631,234 | S | 1/2011 | Kasprzak | |
| D632,466 | S | 2/2011 | Kasprzak | |
| 7,905,034 | B2 | 3/2011 | Robinson, Jr. et al. | |
| D636,157 | S | 4/2011 | Nascimento | |
| 8,099,880 | B2 | 1/2012 | Brewer et al. | |
| D654,680 | S | 2/2012 | Mochen | |
| D661,075 | S | 6/2012 | Bacon et al. | |
| D663,934 | S | 7/2012 | Bacon | |
| D664,344 | S | 7/2012 | Bacon et al. | |
| D667,204 | S | 9/2012 | Campbell et al. | |
| D667,205 | S | 9/2012 | Campbell et al. | |
| 8,286,371 | B2 | 10/2012 | Baker et al. | |
| D670,490 | S | 11/2012 | McClaskie | |
| D671,726 | S | 12/2012 | Petrie | |
| 8,356,428 | B2 | 1/2013 | Auger et al. | |
| 8,677,657 | B2 * | 3/2014 | Bacon et al. | 36/127 |
| 2002/0100190 | A1 * | 8/2002 | Pellerin | 36/126 |
| 2006/0213088 | A1 | 9/2006 | Grove et al. | |
| 2007/0199211 | A1 * | 8/2007 | Campbell | 36/59 R |
| 2009/0013561 | A1 * | 1/2009 | Robinson et al. | 36/127 |
| 2009/0113765 | A1 * | 5/2009 | Robinson et al. | 36/127 |
| 2009/0249648 | A1 * | 10/2009 | Brown et al. | 36/91 |
| 2010/0083539 | A1 * | 4/2010 | Norton | 36/127 |
| 2010/0139129 | A1 | 6/2010 | Kuhtz et al. | |
| 2010/0257751 | A1 | 10/2010 | Burt et al. | |
| 2011/0146108 | A1 | 6/2011 | Grott et al. | |
| 2012/0159816 | A1 * | 6/2012 | Wu | 36/134 |
| 2012/0233887 | A1 | 9/2012 | Baker et al. | |
| 2013/0326908 | A1 * | 12/2013 | Grott et al. | 36/62 |

* cited by examiner

GOLF SHOE OUTSOLE

CROSS REFERENCE TO RELATED APPLICATION

This application claims the benefit of U.S. Provisional Application No. 61/659,119, filed Jun. 13, 2012, which is incorporated herein by reference in its entirety.

FIELD

This application relates to golf shoe outsoles and other athletic shoe outsoles subject to dynamic loading and weight shift during athletic activities, especially on grass covered ground surfaces.

BACKGROUND

A golf shoe, and especially the outsole of a golf shoe, plays an important role during a golfer's swing because it serves as the golfer's sole contact surface with the ground and acts as a platform to support the golfer during the golf swing. The golfer's footwork is important to the execution of a proper and effective golf swing.

The golfer's footwork during the swing is nuanced and differs from left foot to right foot. In general, for most golf shots the golfer's weight is initially distributed 50/50 on each foot and the weight is centered in the middle of each foot. During the backswing, the golfer's weight should shift to the outside (lateral side) of the golfer's back foot while the front foot maintains some weight for balance. The backswing applies forces tending to spin or pivot the back forefoot outwardly and the back heel inwardly, which must be resisted by the back foot's contact with the ground to keep the golfer's back foot stable. During the downswing of the club, the golfer's weight begins to shift and by the time the golf ball is struck, the golfer's weight is evenly balanced on the rear foot and front foot or has started to shift more to the front foot. At the finish position of the swing, most of the golfer's weight is on the front foot with more weight on the outside (lateral side) of the front foot than the inside (medial side), and the golfer's heel and shoe outsole are elevated above the ground and facing rearwardly. In a proper swing, only the toe of the golfer's rear foot remains in contact with the ground at the finish. In the finish position the heel and most of the outsole of the golfer's rear shoe are off of the ground, with only the toe contacting the ground for balance.

With the foregoing footwork, the golfer's weight on any local area of the outsole constantly changes and shifts throughout the golf swing.

Improvements in the golf shoe outsole that provide the golfer with greater traction, better stability, improved overall balance, and greater power and consistency during the golf swing are most desirable.

SUMMARY

Some embodiments of a golf shoe outsole have a heel end, opposite toe end, lateral side and opposite medial side. The outsole member defines a lateral-medial midline through the outsole that divides the outsole into a forefoot region forward of the midline and a heel-arch region rearward of the midline. The forefoot region has an outer perimeter that extends from the medial side of the midline around the toe end to the lateral side of the midline. The outsole comprises a thin, flexible base layer that extends across the forefoot region to the outer perimeter. The forefoot region further comprises at least seven platforms disposed around the outer perimeter and projecting downwardly from the base layer. The platforms are separated from one another by portions of the base layer such that channels are defined extending inwardly from the outer perimeter between adjacent pairs of the platforms. A first plurality of the platforms each comprise two or more static traction elements extending downwardly from the respective platform and a second plurality of the platforms are each configured to mount a static traction element extending downwardly from the respective platform.

In some of these embodiments, the forefoot region further comprises a central basin that is devoid of traction elements. The central basin borders at least three of the platforms, communicates with the channels between the platforms, and has about the same thickness as the channels between the platforms.

Some embodiments of a golf shoe outsole have a heel end, opposite toe end, lateral side and opposed medial side, with the outsole member defining a lateral-medial midline through the outsole that divides the outsole into a forefoot region forward of the midline and a heel-arch region rearward of the midline. The forefoot region comprises a plurality of discrete platforms extending downwardly from a thin, flexible base layer that extends across the forefoot region. The plurality of platforms and the base layer define a forked channel extending below the base layer and between the platforms. The forked channel comprises a stem portion extending inwardly from the medial perimeter of the forefoot, a forward branch extending from the stem portion to the lateral perimeter of the forefoot, and a rearward branch extending from the stem portion to the lateral perimeter of the forefoot rearward of the forward branch. The rearward branch and the stem portion can be aligned and form a linear channel extending across the entire forefoot region. The forward branch can comprise at least three discrete aligned sub-channels, each sub-channel defined by a separate pair of the platforms. The forked channel can further comprise an intermediate branch that extends from the rearward branch to the lateral perimeter and is positioned between the forward and rearward branches.

Some embodiments of a golf shoe outsole have a heel end, opposite toe end, lateral side and opposite medial side, with the outsole defining a lateral-medial midline through the outsole that divides the outsole into a forefoot region forward of the midline and a rear portion rearward of the midline and the rear portion having a heel region proximate the heel end and an arch region between the heel region and the midline. The forefoot region and the heel region each comprise at least one dynamic traction element and the arch region comprises at least one static traction element positioned along the medial side of the arch region. The outsole can comprises a thin, flexible base layer extending the entire width and length of the outsole and the arch region can comprise at least one platform projecting downwardly from the medial side of the base layer and at least one static traction element extending downwardly from each platform. At least two static traction elements can extend downwardly from each platform. The arch region can comprise at least two platforms projecting downwardly from the medial side of the base layer with a portion of the base layer being exposed between the platforms. A lateral half of the arch region can be free of traction elements.

Some embodiments of an outsole have a heel end, opposite toe end, lateral side and opposite medial side, with the outsole member defining a lateral-medial midline through the outsole that divides the outsole into a forefoot region forward of the midline and a heel-arch region rearward of the midline and the forefoot region having an outer perimeter that extends from the medial side of the midline around the toe end to the lateral side of the midline. The forefoot region comprises a plurality of discrete platforms extending downwardly from a thin, flexible base layer that extends across the forefoot region. The plurality of platforms comprise a first group of platforms disposed around the outer perimeter of the forefoot and a second group of platforms clustered at a central portion of the forefoot within the first group of platforms. The plurality of platforms and the base layer define a forked channel extending below the base layer and between the platforms. The forked channel comprises a stem portion extending longitudinally from the midline between the first group of platforms, a medial branch extending from the stem portion through the first group of platforms to the medial perimeter of the forefoot, and a lateral branch extending from the stem portion between the first group of platforms to the lateral perimeter of the forefoot. The forked channel can further comprise at least one intermediate branch extending from the stem portion between the first group of platforms to the outer perimeter between the medial branch and the lateral branch. The forefoot region can comprises an open region forward of the first group of platforms that is free of platforms and connects the stem portion with the branches. The first group of platforms can comprise three pairs of platforms, each pair of platforms defining a different segment of the stem portion.

The foregoing and other objects, features, and advantages of the invention will become more apparent from the following detailed description, which proceeds with reference to the accompanying figures.

DETAILED DESCRIPTION

The following description is exemplary in nature and is not intended to limit the scope, applicability, or configuration of the disclosed embodiments in any way. Various changes to the described embodiment may be made in the function and arrangement of the elements described herein without departing from the scope of the disclosure.

As used in this application and in the claims, the singular forms "a" and "the" include the plural forms unless the context clearly dictates otherwise. Additionally, the term "includes" means "comprises."

Moreover, for the sake of simplicity, the attached figures may not show the various ways (readily discernible, based on this disclosure, by one of ordinary skill in the art) in which the disclosed apparatus can be used in combination with other systems, methods and apparatuses.

A golf shoe outsole 10 is shown and described in various embodiments herein. The outsole 10 comprises a thin, flexible base layer having many discrete platforms projecting downwardly from the base layer for providing traction elements. The platforms are separated by channels and open regions to allow the discrete platforms to readily flex relative to one another about the thin base layer, providing enhanced flexibility to the outsole and improved traction performance during a dynamic act such as a golf swing.

Figure 1:
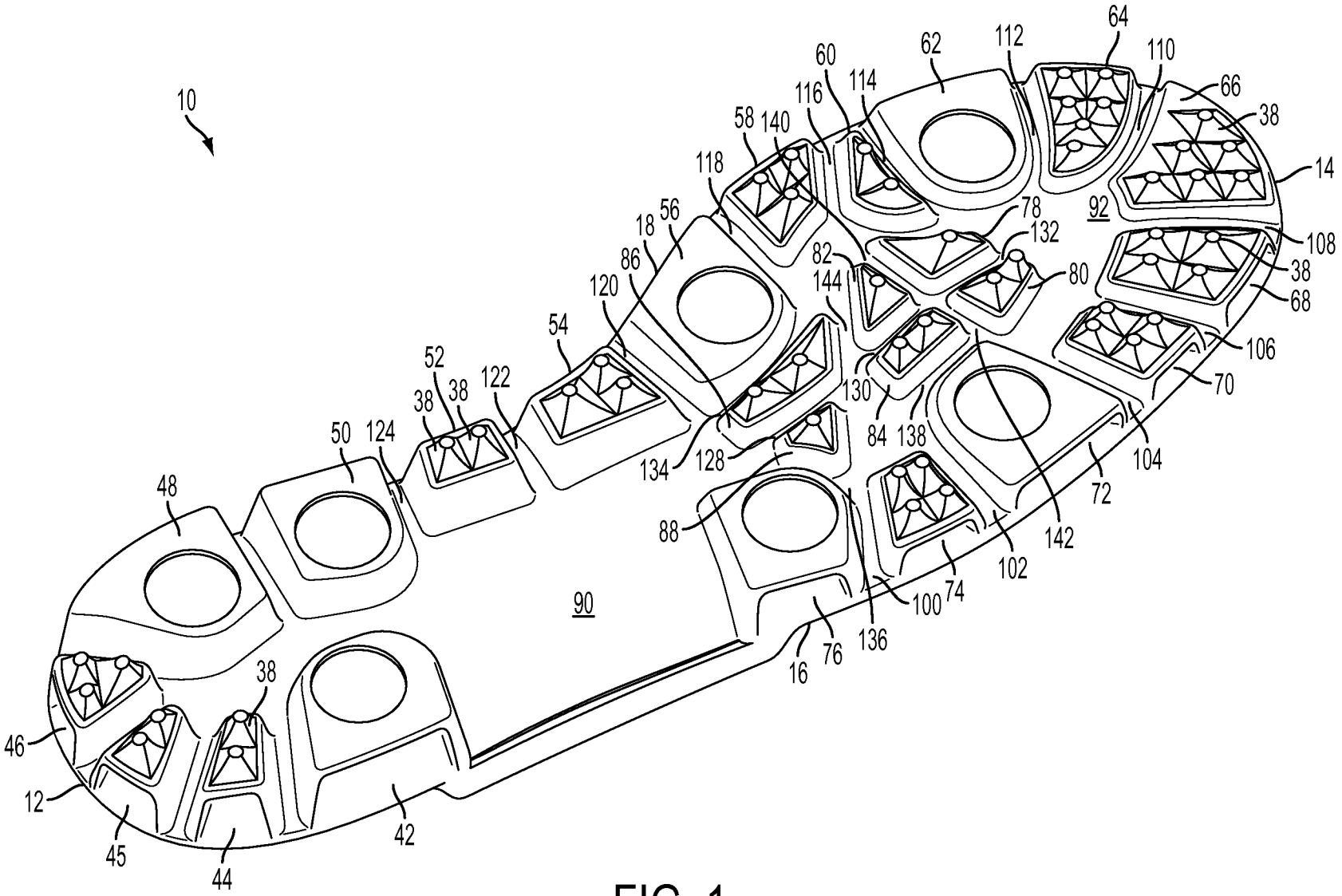
FIG. 1 is a perspective view of a golf shoe outsole.
Figure 2:
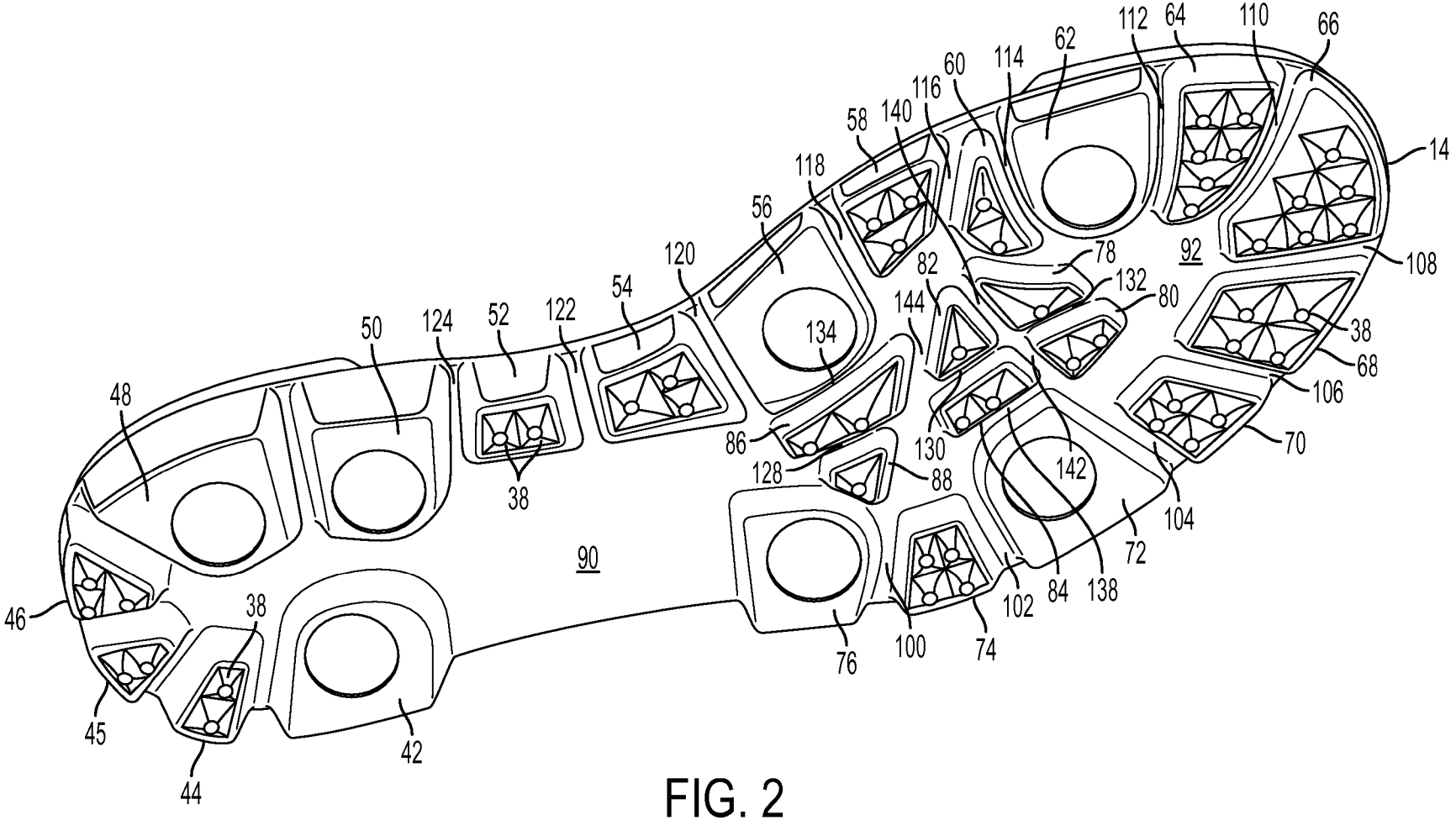
FIG. 2 is another perspective view of the golf shoe outsole of FIG. 1.
Figure 3:
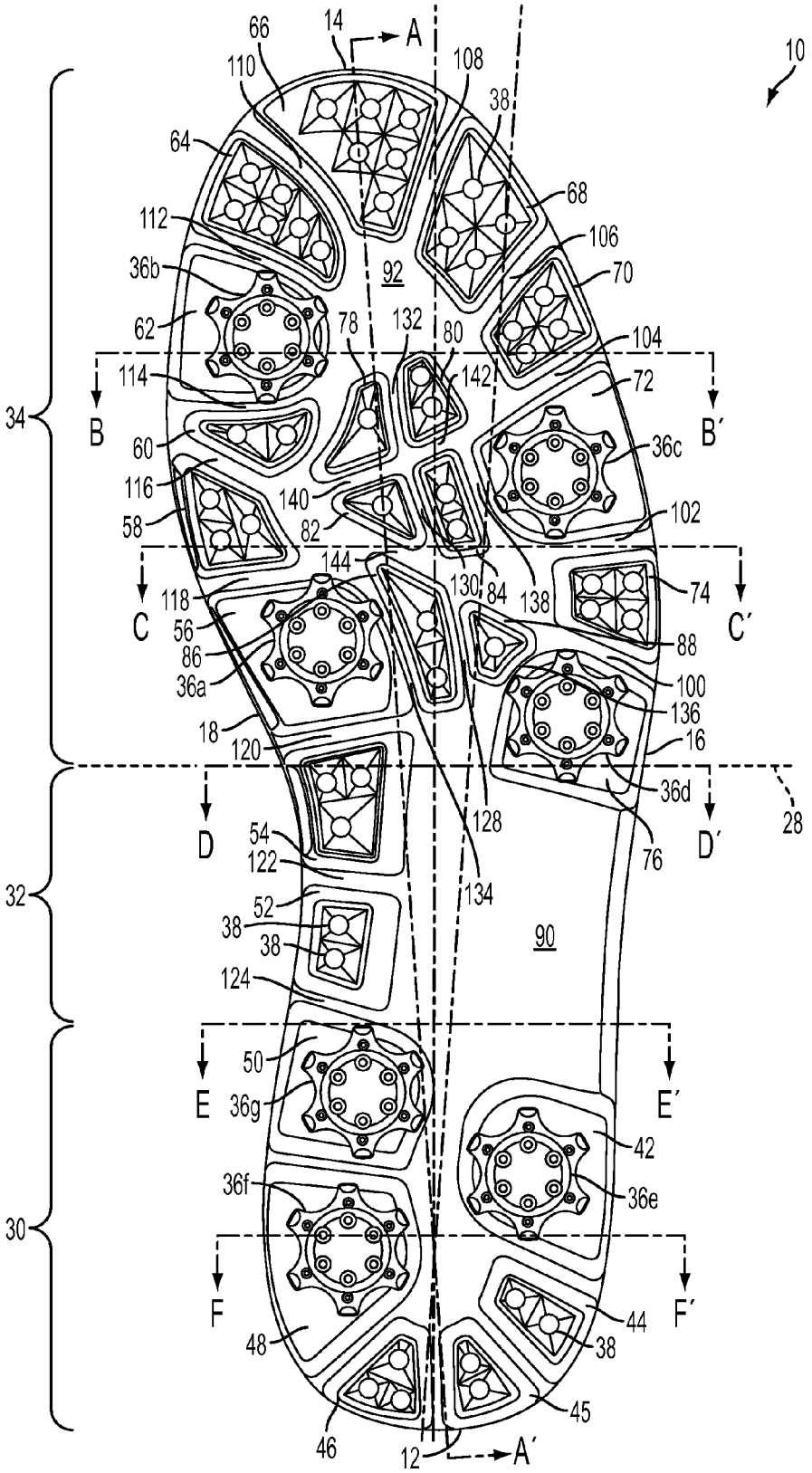
FIG. 3 is a bottom view of the outsole of FIG. 1.

Outsole 10 has a heel end 12, opposite toe end 14, lateral side edge 16 and medial side edge 18, as shown in FIGS. 1-3. An upper surface 20 of the outsole is configured to be coupled to other portions of a shoe, such as a cushioning midsole and an upper. From a reference standpoint, outsole 10 can be divided into a heel region 30 proximate the heel end 12, an arch region 32, and a forefoot region 34 proximate the toe end 14 (FIG. 3). A boundary between the arch region 32 and forefoot region 34 can define a medial-lateral midline 28 (FIG. 3) that divides the outsole into a forward half and a rearward half.

Heel region 30 generally corresponds to the portion of the outsole underlying the golfer's heel. Arch region 34 generally corresponds to the portion of the outsole underlying the golfer's arch. Forefoot region 32 generally corresponds to the portion of the outsole beneath the golfer's forefoot. It will be appreciated that the boundaries between these regions are not precise, but are understood to generally correspond to the anatomy of the golfer's foot.

As shown in FIG. 3, a longitudinal line A-A' extends from the rear end of the heel to the tip of the toe and generally divides the outsole into medial and lateral portions. The line A-A' is only for reference and does not actually divide the outsole into equal halves. Due to the asymmetric nature of the human foot and outsole 10, a true longitudinal centerline of the outsole would not be a straight line. Rather, in contrast to the line A-A', the true longitudinal centerline would be curved toward the medial side 18 moving from the heel to the toe.

As shown in FIGS. 1-3, in one exemplary embodiment, outsole 10 has a plurality of primary "active" or dynamic traction elements 36 and secondary static traction elements 38 on the bottom of the outsole to provide traction and stability for the golfer.

Dynamic traction elements 36 preferably are detachable spike cleats that are omni-directional and may be detached and replaced when they wear out. Spike cleats 36 preferably each have resilient legs spaced radially around the center of the cleat, which dynamically (or actively) flex depending on the amount of weight or loading to which the spike cleat is subject. Each spike cleat 36 can have a threaded end and be attached to a corresponding threaded receptacle 40 (see FIGS. 10, 12, 14) formed in the outsole 10 during the molding process. An example of an alternative detachable non-threaded spike cleat that may be used and methods of mounting same is described in published application U.S. 2010/0257751, which is incorporated herein by reference. It will be appreciated that other types of dynamic traction elements having flexible spring-like elements other than the legs of the spike cleats shown may be used as well. In addition, dynamic traction elements that are permanently attached to the outsole may be used in place of detachable spike cleats 36, but without the advantage of being replaceable.

The primary dynamic traction elements 36 can include four spike cleats 36*a*, 36*b*, 36*c*, 36*d* located at least substantially within forefoot region 34, with 36*a* and 36*b* being positioned on the medial side 18 and 36*c* and 36*d* being positioned on the lateral side 16. The primary dynamic traction elements 36 can further include three spike cleats 36*e*, 36*f*, 36*g* located substantially within the heel region 30, with 36*e* being on the lateral side 16 and 36*f*, 36*g* being on the medial side. The number and position of the spike cleats 36 can vary, though desirably there are at least one in the heel region 30 and at least one in the forefoot region 34. In some embodiments, there can be four or more spike cleats 36 in the heel region 34 and six or more spike cleats 36 in the forefoot region 34. Some embodiments can further comprise one or more spike cleats 36 in the arch region 32, such as on the medial side.

Secondary static traction elements 38 can be lug style cleats that are an integral extension of the platform underlying them and are formed as part of the outsole molding process. The lug cleats are dispersed throughout the outsole, typically in groups extending from a common platform, to provide additional static traction, such as during heaving loading. Lug cleats 38 do not have flex elements like dynamic traction elements 36 and are much less flexible than spike cleats. While the lug cleats 38 may elastically deform to a small degree, they do not have dynamic flex elements comparable to the legs of spike cleats 36. The lug cleats optionally have a frusto-pyramidal shape and can be directionally oriented to provide increased traction and resistance in certain directions. Together, the spike cleats 36 and the lug cleats 38 can provide omni-directional traction throughout the outsole.

The spike cleats 36 typically have a height 24 (see FIG. 5) of about 6.5 mm from the underlying platform surface. The lug cleats 38 desirably have a height 26 (see FIG. 5) that is less than the height 24 of the spike cleats 36, as for example about 3.5 mm to about 4.5 mm. The difference in height (about 2 mm to about 3 mm) generally causes the spike cleats 36 to serve as a primary traction mechanism and the lug cleats 38 to serve as secondary traction mechanism depending on the hardness of the ground and magnitude of the load or force applied in the local area of the outsole. For example, in particularly soft ground in which the spike cleats 36 are more deeply embedded in the ground surface, the lug cleats 38 likewise will engage the ground to provide additional traction. In harder ground and especially with a lighter golfer, many of the lug cleats 38 may not engage the ground surface when the golfer's weight is evenly balanced on both shoes.

A height difference of about 2 mm is generally preferred. Thus, if the spike cleats have a height of 7.5 mm, as measured from the base of the outsole, the at least some of the adjacent lug cleats can have a height of 5.5 mm.

The orientation and pattern of the spike cleats 36 and lug cleats 38 shown in FIGS. 1-3 are designed to complement and facilitate proper footwork as the golfer's weight is dynamically supported and shifted during the golf swing.

The dynamic and static traction elements extend downwardly from a plurality of platforms 42-88. Each of the platforms can comprise a portion of the outsole 10 that projects downwardly from the thin, flexible base layer, which forms the upper surface 20 of the outsole and has a thickness 22 of less than 3.0 mm, less than 2.5 mm, less than 2.2 mm, and/or about 2.0 mm. Some of the platforms (42, 48, 50, 56, 62, 72 and 76) mount dynamic traction elements 36 while the other platforms support one or more static traction elements 38.

Figure 5:
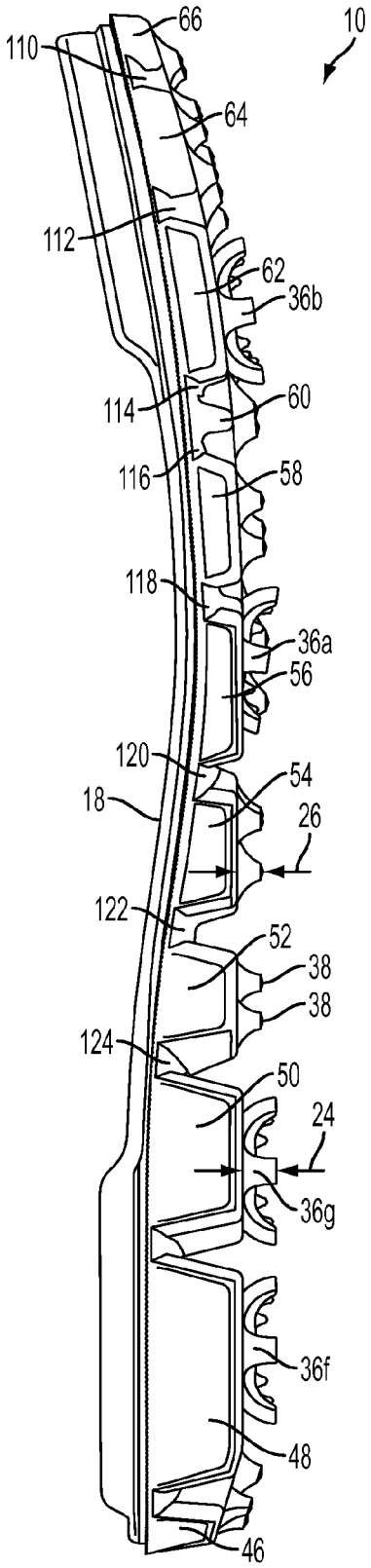
FIG. 5 is a side elevation view of a medial portion of the outsole of FIG. 1.
Figure 6:
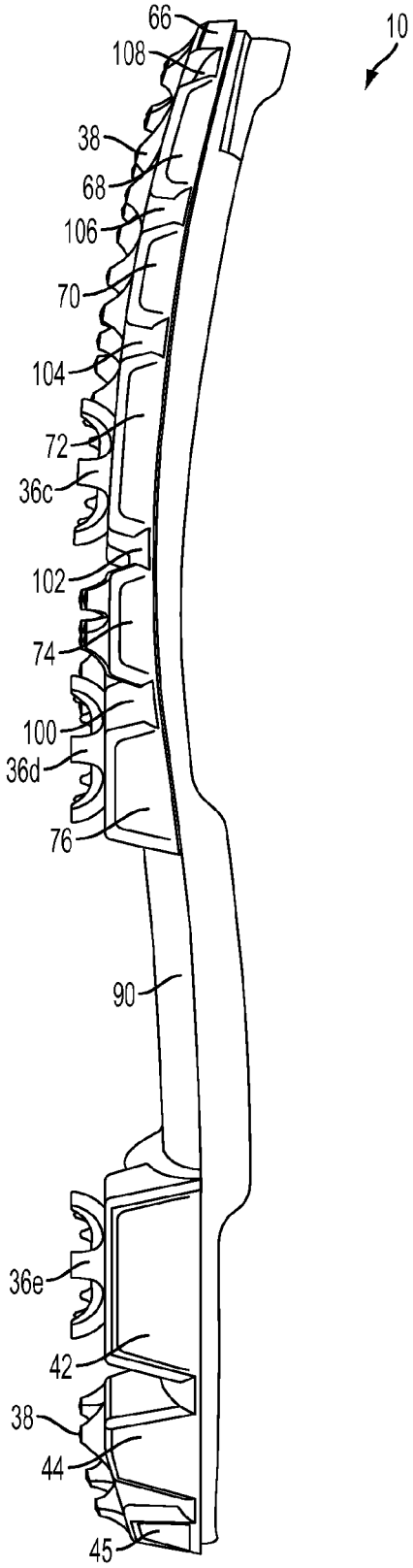
FIG. 6 is a side elevation view of a lateral portion of the outsole of FIG. 1.

The platforms can extend downwardly from the base layer to a generally even lower level such that the lower ends of adjacent platforms are generally even with each other. These heights can gradually change moving across the shoe, however. The general evenness of the lower ends of the platforms can allow the various traction elements to extend downwardly from a generally even level. As shown in FIGS. 5 and 6, the spike cleats 36 and the neighboring lug cleats 38 have an equal upper level, although they project downwardly differently distances from that equal upper level. The can help maintain a desired vertical difference in the lower ends of the static cleats versus the dynamic cleats, such as about 2.0 mm.

In the illustrated embodiment, platforms 42, 44, 45, 46, 48 and 50 are disposed around the perimeter of the heel region 30, platforms 52 and 54 are disposed on the medial side of the arch region 32, platforms 56, 58, 60, 62, 64, 66, 66, 68, 70, 72, 74 and 76 are disposed around the perimeter of the forefoot region 34, and platforms 78, 80, 82, 84, 86 and 88 are disposed in the interior of the forefoot region.

In some embodiments, the forefoot region comprises at least seven platforms disposed around the outer perimeter. For example, some of the illustrated platforms can be combined together, such as platforms 60, 62 and/or 64, or platforms 68 and 70. At least three of the forefoot perimeter platforms can be configured to mount a static traction element. At least four of the forefoot perimeter platforms can comprise three or more, or four or more static traction elements. Some can comprise five, six or more static traction elements, such as platforms 64 and 66 at the toe region.

The platforms on the perimeter of the forefoot region 34 can have a variable height that is generally larger at the perimeter side of the platform and general smaller at the interior side of the platform. Each platform can extend downwardly at least 3.0-3.5 mm from the base layer. Table 1 below lists approximate platform height dimensions for one embodiment of the outsole 10.

TABLE 1

| Platform | Height Adjacent Perimeter (mm) | Height Adjacent Interior (mm) |
|---|---|---|
| 54 | 10.5 | 6.5 |
| 56 | 7.0 | 4.7 |
| 58 | 7.0 | 4.5 |
| 60 | 5.0 | 5.0 |
| 62 | 8.8 | 4.5 |
| 64 | 7.5 | 3.5 |
| 66 | 4.0 | 2.0 |
| 68 | 5.5 | 4.0 |
| 70 | 7.0 | 5.3 |
| 72 | 7.0 | 4.5 |
| 74 | 7.0 | 4.2 |
| 76 | 12.5 | 6.9 |

Each of the platforms is separated from adjacent platforms by a thin portion of the base layer forming a channel between adjacent platforms such that each of the platforms is provided with a measure of independence from the adjacent platforms. This allows each of the platforms to flex relative to the adjacent platform. In a conventional golf shoe outsole, less flexibility is provided between each traction element such that the entire outsole tends to move as a static unit, or with only minimal bending between the various traction elements. Thus, if for example the medial side of the forefoot of a conventional golf shoe outsole is lift off the ground, the whole outsole tends to tilt up as a unit, leaving only the lateral edge of the forefoot in contact with the ground. In contrast, the discrete platforms of the disclosed outsole are provided with great flexibility relative to one another due to the flexible channels between the platforms.

Many groups of the channels are aligned to provide synergistic flexibility properties between groups of the platforms. For example, if the medial side of the forefoot region 34 is lifted off the ground by the golfer's motion, only the traction elements of the platforms along the medial edge, such as 56, 58, 60, 62 and 64, may separate from the ground, leaving the traction elements of the remaining platforms engaged with the ground, thus providing improved traction performance compared with stiffer conventional outsoles. In addition, many of the channels, and groups of channels, are positioned to generally correspond to the natural bending regions of a human foot.

Static cleats 38 on platforms 52 and 54 provide traction under the medial side of the arch of the golfer's foot in an area normally separated from the ground surface in a conventional golf shoe having a raised heel. Static cleats 52, 54 are located substantially within, and most preferably completely within, arch region 32, and substantially or completely on the medial side of midline A-A'. The platforms 52 and 54 are separated by channel 122 to allow the two platforms to flex independently. Further, the platforms 52, 54 are separated from the platform 50 by channel 124 and from platform 56 by channel 120. The lateral side of the arch region 34 can be devoid of platforms and/or traction elements, leaving a region of the base layer exposed between the forefoot region 34 and the heel region 30 along the lateral side 16.

In some embodiments, the outsole can comprise at least seven, eight, or nine channels disposed around the outer perimeter of the forefoot region 34. In the illustrated embodiment, channels 100, 102, 104, 106, 108, 110, 112, 114, 116, 118 and 120 are disposed around the outer perimeter of the forefoot region 34 between the platforms and extend inwardly from the outer perimeter of the forefoot region to an interior area of the forefoot region. These channels can differ in width relative to each other. In addition, some of these channels can vary in width along their length. Furthermore, each channel can be narrower adjacent to the base layer and broaden moving downward toward the bottom sides of the platforms because the platform sidewall can taper moving downward. Table 2 below lists approximate widths of the channels around the perimeter of the forefoot adjacent to the base layer for an exemplary embodiment.

TABLE 2

| Channel | Width Adjacent Perimeter (mm) | Width Adjacent Interior (mm) |
|---|---|---|
| 100 | 3.5 | 3.0 |
| 102 | 3.5 | 3.0 |
| 104 | 3.0 | 3.0 |
| 106 | 3.0 | 3.0 |
| 108 | 3.5 | 3.5 |
| 110 | 3.0 | 3.0 |
| 112 | 2.0 | 2.0 |
| 114 | 1.5 | 1.5 |
| 116 | 3.5 | 3.5 |
| 118 | 3.5 | 3.5 |
| 120 | 3.0 | 3.0 |

Some of the channels have narrower widths than other channels. Wider channels can allow greater bending between the adjacent platforms and narrower channels can allow the platforms to be positioned nearer together to increase the number of traction elements in a given region. Regions of the outsole where greater degrees of bending are expected or desired can be provided with larger channel widths. In some embodiments, each channel around the perimeter of the forefoot region 34 has a minimum width adjacent the base layer of between 1.0 mm and 4.0 mm. In some embodiments, the perimeter channels on a lateral half of the forefoot region each have a minimum width adjacent the base layer of at least 2.5 mm. In some embodiments, a majority of the perimeter channels in the forefoot region have a minimum width adjacent the base layer of at least 2.9 mm.

In addition to the channels disposed around the perimeter of the outsole, channels 128, 130, 132, 134, 136, 138, 140, 142 and 144 are positioned in the interior of the forefoot and separate the interior platforms 78-88 from one another and from some of the perimeter platforms. Channels 128, 130, 132 are generally aligned longitudinally between the interior platforms and form synergistic "super channel" that allows the medial side of the forefoot region 34 to flex relative to the lateral side of the forefoot region. The rear end of this super channel communicates with the open area 90 in the arch region 32 and the toe end of this super channel communicates with an open region 92, or basin, in the forefoot region 34. The open region 92 can further communicate with the perimeter channels 106, 108, 110, 112, and 114 to extend the super channel 128/130/132 in a branching pattern to the perimeter of the forefoot region. This can provide even greater flexibility of the forefoot region about longitudinal folding axes. The interior channels 134, 136 and 138 are also somewhat longitudinally oriented and can further enhance the flexibility of the forefoot region 24 about longitudinal folding axes.

Some of the channels in the forefoot region 34 can synergistically provide enhanced flexibility about medial-lateral folding axes. For example, channels 116, 144 and 100 are generally aligned to form a super channel extending across the forefoot region from the medial side 18 to the lateral side 16. Channels 116, 140, 142 and 104 form another super channel extending across the forefoot region. Channels 116, 144 and 102 form yet another super channel extending across the forefoot region. Channels 118, 144 and 102 form still another super channel extending across the forefoot region. Many other similar super channels can similarly be defined. These horizontal super channels can allow a forward portion of the forefoot region to more readily bend relative to a rearward portion of the forefoot region.

A branched super channel can be defined that comprises a stem portion 116, a forward branch comprising channels 140, 142, 104, a rearward branch comprising channels 144, 100, and an intermediate branch 102 extending from the rearward branch. Platforms 82, 84 and 72 divide the forward branch from the intermediate branch, and platform 74 divides the intermediate branch from the rearward branch. Channel 134 can comprise yet another branch extending rearward to the arch region. Generally triangular platform 82 can define a main fork in this branch super channel and platforms 86 and 74 can define secondary forks. The individual channels that form a super channel can alternatively be termed sub-channels and the super channel can be termed simply as a channel composed of plural sub-channels.

Figure 4:
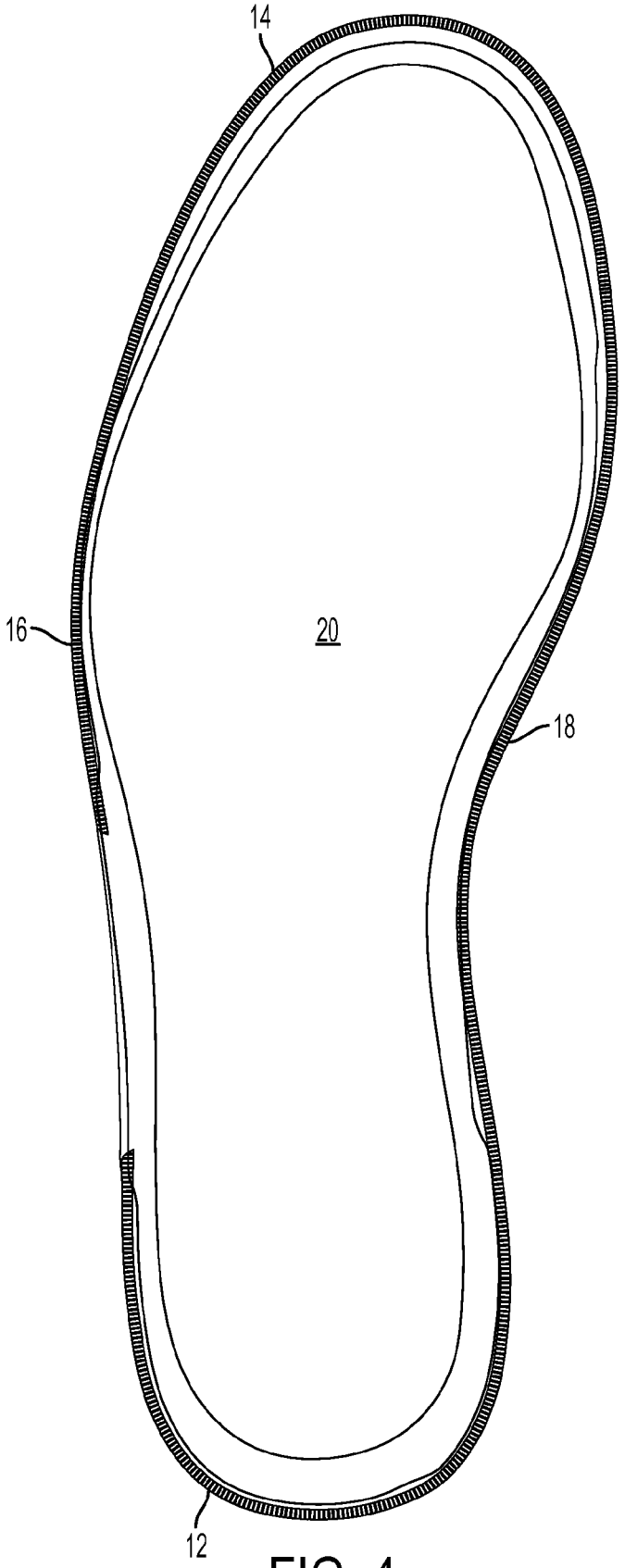
FIG. 4 is a top view of the outsole of FIG. 1.
Figure 7:
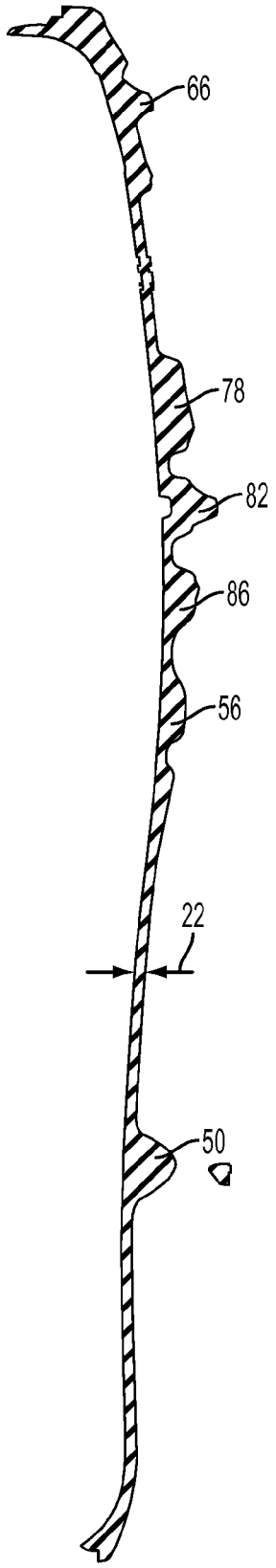
FIG. 7 is a cross section view of the outsole of FIG. 1, taken along line A-A' of FIG. 3.

FIGS. 5 and 6 show elevation views of medial and lateral halves of the outsole, respectively, and FIG. 7 shows a longitudinal cross-sectional profile of the outsole 10 along section line A-A'. FIGS. 5-7 illustrate the relative height dimensions of the base layer, platforms and traction elements. The upper surface 20 of the outsole (FIG. 4) may be attached, such as by gluing, to a cushioning midsole, and coupled to an upper using a lasting board and strobel, or using other conventional techniques known to those of routine skill in the art. The outsole also may be formed with lateral stability element on the lateral side of the outsole.

Figure 8:
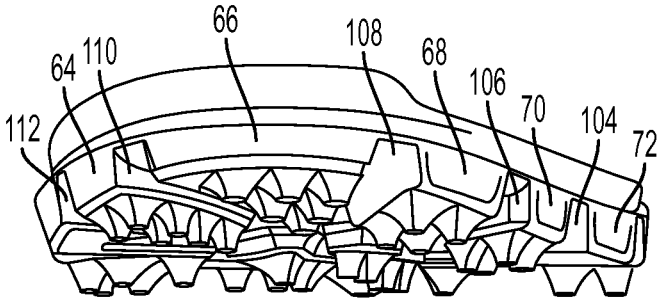
FIG. 8 is an elevation view of the toe of the outsole of FIG. 1.
Figure 9:
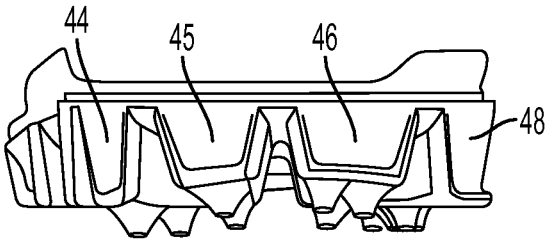
FIG. 9 is an elevation view of the heel of the outsole of FIG. 1.

FIGS. 8 and 9 show toe and heel views, respectively, including platforms 64, 66, 68, 70 and 72 located in forefoot region 34, and platforms 44, 45, 46 and 48 located in the heel region 30, and some of the channels separating these platforms.

Figure 10:
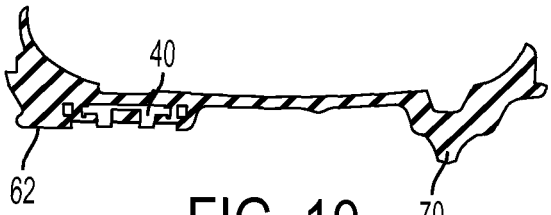
FIG. 10 is a cross section view of the outsole of FIG. 1, taken along line B-B' of FIG. 3.

FIG. 10 is a sectional view taken along line B-B' of FIG. 3, showing the platform 62 on the medial side with an empty spike cleat receptacle 40 and the spike cleat 36*b* removed, and showing the platform 70 with one of the lug cleats 38 on the lateral side.

Figure 11:
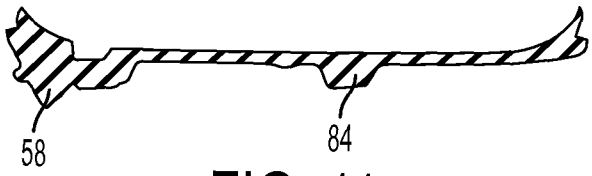
FIG. 11 is a cross section view of the outsole of FIG. 1, taken along line C-C' of FIG. 3.

FIG. 11 is a sectional view taken along line C-C' of FIG. 3, showing the platform 58 on the medial side and the platform 84 toward the lateral side.

Figure 12:
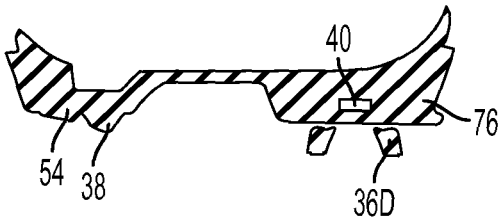
FIG. 12 is a cross section view of the outsole of FIG. 1, taken along line D-D' of FIG. 3.

FIG. 12 is a sectional view taken along line D-D' of FIG. 3, showing the arch platform 54 on the medial side and the platform 76 and spike cleat 36*d* on the lateral side.

Figure 13:
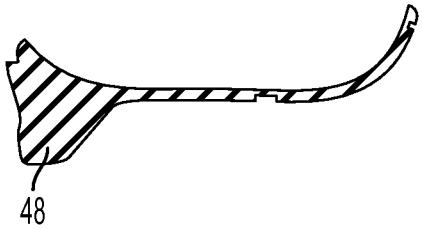
FIG. 13 is a cross section view of the outsole of FIG. 1, taken along line E-E' of FIG. 3.

FIG. 13 is a sectional view taken along line E-E' of FIG. 3, showing the platform 50 on the medial side and the open region 90 the lateral side.

Figure 14:
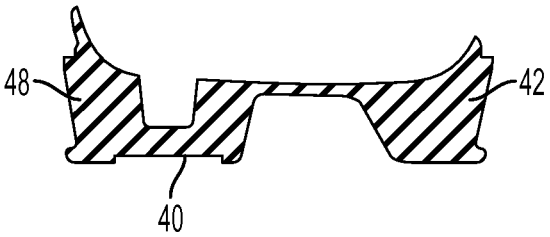
FIG. 14 is a cross section view of the outsole of FIG. 1, taken along line F-F' of FIG. 3.

FIG. 14 is a sectional view taken along line F-F' of FIG. 3, showing the platform 48 on the medial side and the platform 42 toward the lateral side.

The outsole may be formed in any one of a number of conventional methods, including one or more injection molding steps and compression molding. Once formed, a midsole may be formed of a complementary shape and attached to the heel, arch and/or forefoot regions of the outsole by gluing or otherwise. The resulting outsole and midsole construction then may be attached to an upper in a conventional manner.

The cushioning midsole may be formed from a variety of materials known in the art including ethyl vinyl acetate (EPA) or blown thermoplastic polyurethane (TPU), or blown thermoplastic polyurea (TPUA). Other suitable materials include both natural and synthetic rubbers, such as cis-1,4-polybutadiene, trans-1,4-polybutadiene, 1,2-polybutadiene, cis-polyisoprene, trans-polyisoprene, polychloroprene, polybutylene, the styrenic block copolymers such as styrene-butadiene-styrene (SBS), styrene-ethylene-butylene-styrene, (SEBS) and styrene-ethylenepropylene-styrene (SEPS), (commercial examples include SEPTON marketed by Kuraray Company of Kurashiki, Japan; TOPRENE by Kumho Petrochemical Co., Ltd and KRATON marketed by Kraton Polymers).

The outsole may be made from a variety of materials known in the art including polyurethane (PU), polyurea (PUA) (especially thermoplastic polyurethane (TPU) and thermoplastic polyurea (TPUA)), ethyl vinyl acetate (EVA) nylon, carbon fiber, glass fiber, polyaramid (generally designated in the art as an aromatic polycarbonamide) which include those commercially available under the tradenames Kevlar® (E.I. du Pont de Nemours and Company), Twaron® (Akzo Nobel), Technora (Teijin), Nomex® and Nomex Z200 (E.I. du Pont de Nemours and Company), Teijinconex (Teijin), and Apial (Unitika). Other suitable materials include both natural and synthetic rubbers, such as cis-1,4-polybutadiene, trans-1,4-polybutadiene, 1,2-polybutadiene, cis-polyisoprene, trans-polyisoprene, polychloroprene, polybutylene, the styrenic block copolymers such as styrene-butadiene-styrene (SBS), styrene-ethylene-butylene-styrene, (SEBS) and styrene-ethylenepropylene-styrene (SEPS), (commercial examples include SEPTON marketed by Kuraray Company of Kurashiki, Japan; TOPRENE by Kumho Petrochemical Co., Ltd and KRATON marketed by Kraton Polymers). Other suitable materials include the amide block copolymers and ester block copolyethers. The amide block copolymers (PEBA) are well known under the trademark PEBAX® commercialized by ATOCHEM. The ester block polyethers (PEBE) include products that have a rigid phase of the terephtalate polybutadiene type (PBT). These are known under the trademark HYTREL® (E.I. du Pont de Nemours and Company) or ARNITEL® (AKZO).

Despite conventional wisdom, it is believed that a golfer's footwork can be best served to promote a proper swing by giving both feet greater freedom to move and flex during the swing. A golfer's footwork can also be best served by providing traction elements under the soft tissue of both feet, such as the traction elements positioned on the medial side of the arch region 32.

The disclosed outsole/shoe distributes the golfer's weight over a wider surface area in contact with the ground by allowing more of the traction elements to remain engaged with the ground when other parts of the outsole are lifted off the ground. The traction elements of each platform can flex and respond independently to dynamic loading and weight shift, thereby allowing local areas of the outsole advantageously to remain in contact with the ground as long as possible. For example, during the swing follow-through after impact, the medial forefoot traction elements can remain engaged with the ground for an interval of time after the lateral forefoot traction elements lose contact as the heel lifts and the medial forefoot lifts. Further, the thin base layer provides a low flat profile for the forefoot region that moves the golfer's center of gravity closer to the ground.

The numerous and relatively deep channels and open areas disposed around the outsole can also provide enhanced performance under wet conditions, as more mud and water on the upper surface of the ground is allowed to move into the large volumes defined by the channels and open areas such that the traction elements can more readily reach down through the mud and water to more solid turf.

These features provide the golfer with greater traction, better stability, improved overall balance, and a foundation for greater power and consistency during the golf swing. The flexibility of the outsole makes it easier for the golfer to shift weight in the proper manner during the golf swing.

This approach contrasts with many golf shoes that provide relatively rigid outsoles, thick base layers that elevate a golfer's center of gravity, and traction elements focused only in the heel and forefoot regions of the shoe.

It will be appreciated that the principles and embodiments disclosed herein have application to other types of athletic shoes/outsoles that are subject to dynamic loading and weight shift and require outstanding traction, especially athletic shoes used on grass surfaces.

In view of the many possible embodiments to which the principles of this disclosure may be applied, it should be recognized that the illustrated embodiments are only preferred examples and should not be taken as limiting the scope of the disclosure. Rather, the scope of the disclosure is at least as broad as the following claims. We therefore claim all that comes within the scope and spirit of these claims.

We claim:

1. A golf shoe outsole having a heel end, opposite toe end, lateral side and opposed medial side, the outsole member defining a lateral-medial midline through the outsole that divides the outsole into a forefoot region forward of the midline and a heel-arch region rearward of the midline;

wherein the forefoot region comprises a plurality of discrete platforms extending downwardly from a thin, flexible base layer that extends across the forefoot region;

wherein the plurality of platforms and the base layer define a forked channel extending below the base layer and between the platforms, the forked channel comprising a stem portion extending inwardly from the medial perimeter of the forefoot, a forward branch extending from the stem portion to the lateral perimeter of the forefoot, and a rearward branch extending from the stem portion to the lateral perimeter of the forefoot rearward of the forward branch;

wherein the forked channel further comprises an intermediate branch that extends from the rearward branch to the lateral perimeter and is positioned between the forward and rearward branches;

wherein a first one of the platforms is positioned along the lateral perimeter between the rearward branch and the intermediate branch, a second one of the platforms is positioned along the lateral perimeter between the forward branch and the intermediate branch; and wherein the first platform comprises plural static traction members and the second platform is configured to mount a dynamic traction member.

2. The outsole of claim 1, wherein the rearward branch and the stem portion are aligned and form a linear channel extending across the entire forefoot region.

3. The outsole of claim 1, wherein the forward branch comprises at least three discrete aligned sub-channels, each sub-channel defined by a separate pair of the platforms.

4. The outsole of claim 1, wherein a platform having a generally triangular base defines a fork between the forward branch and the rearward branch.

5. The outsole of claim 1, wherein the portions of the base layer forming a roof of the forked channel have a maximum thickness of about 2.5 mm.

6. The outsole of claim 1, wherein the forked channel is bordered by at least 10 platforms extending downward from the base layer.

7. The golf shoe outsole of claim 1, wherein the heel-arch region comprises a heel region and an arch region between the heel region and the forefoot region, and the arch region comprises two platforms projecting downwardly from the medial side of the base layer and at least two static traction elements extending downwardly from each of the two platforms on the medial side of the arch region.

8. The golf shoe outsole of claim 7, wherein a lateral half of the arch region is free of traction elements.

9. The golf shoe outsole of claim 1, wherein the plurality of platforms comprises a first group of platforms disposed around the outer perimeter of the forefoot and a second group of platforms clustered at a central portion of the forefoot within the first group of platforms; and wherein the plurality of platforms and the base layer further define a second forked channel extending below the base layer and between the platforms, the second forked channel comprising a longitudinal stem portion extending longitudinally from the midline between the first group of platforms, a medial branch extending from the longitudinal stem portion through the first group of platforms to the medial perimeter of the forefoot, and a lateral branch extending from the longitudinal stem portion between the first group of platforms to the lateral perimeter of the forefoot.

10. The golf shoe outsole of claim 9, wherein the second forked channel further comprises two intermediate branches extending from the longitudinal stem portion between the first group of platforms to different points on the outer perimeter between the medial branch and the lateral branch.

11. A golf shoe comprising an upper, a midsole, and an outsole, the outsole having a heel end, opposite toe end, lateral side and opposite medial side, the outsole defining a lateral-medial midline through the outsole that divides the outsole into a forefoot region forward of the midline and a rear portion rearward of the midline, the rear portion having a heel region proximate the heel end and an arch region between the heel region and the midline;

wherein the outsole comprises a thin, flexible base layer extending the entire width and length of the outsole;

wherein the forefoot region and the heel region each comprise at least one dynamic traction element;

wherein the arch region comprises two platforms projecting downwardly from the medial side of the base layer, a portion of the base layer being exposed between the two platforms; and wherein the arch region comprises at least two static traction elements extending downwardly from each of the two platforms positioned along the medial side of the arch region.

12. The golf shoe of claim 11, wherein a lateral half of the arch region is free of traction elements.

13. The outsole of claim 11, wherein the forefoot region comprises at least seven platforms disposed around the outer perimeter of the forefoot region and projecting downwardly from the base layer, the at least seven platforms being separated from one another by portions of the base layer such that channels are defined extending inwardly from the outer perimeter between adjacent pairs of the at least seven platforms, and wherein a first plurality of the at least seven platforms each comprise two or more static traction elements extending downwardly from the respective platform and a second plurality of the at least seven platforms are each configured to mount a static traction element extending downwardly from the respective platform.

14. The golf shoe of claim 13, wherein the channels each have a minimum width adjacent the base layer of between 1.0 mm and 4.0 mm.

15. The golf shoe of claim 13, wherein the channels on a lateral half of the forefoot each have a minimum width adjacent the base layer of at least 2.5 mm.

16. The golf shoe of claim 13, wherein a majority of the channels have a minimum width adjacent the base layer of at least 2.9 mm.

17. The golf shoe of claim 11, wherein the base layer has a thickness of less than 2.5 mm and each platform extends downwardly at least 3.0 mm from the base layer.

18. The golf shoe of claim 13, wherein the at least seven platforms comprises at least three platforms each configured to mount a static traction element and at least four platforms each comprising four or more static traction elements.

19. The golf shoe of claim 13, wherein a group of at least four of the platforms in the forefoot region that are adjacent to one another each comprise three or more static traction elements.

20. The golf shoe of claim 13, wherein the forefoot region further comprises a central basin that is devoid of traction elements, the central basin bordering at least three of the platforms and communicating with the channels between the platforms and having about the same thickness as the channels between the platforms.

21. The golf shoe of claim 13, wherein the channels comprise at least nine channels each extending inwardly from the outer perimeter.

22. An athletic shoe outsole having a heel end, opposite toe end, lateral side and opposite medial side, the outsole member defining a lateral-medial midline through the outsole that divides the outsole into a forefoot region forward of the midline and a heel-arch region rearward of the midline, the forefoot region having an outer perimeter that extends from the medial side of the midline around the toe end to the lateral side of the midline;

wherein the forefoot region comprises a plurality of discrete platforms extending downwardly from a thin, flexible base layer that extends across the forefoot region, the plurality of platforms comprising a first group of platforms disposed around the outer perimeter of the forefoot and a second group of platforms clustered at a central portion of the forefoot within the first group of platforms;

wherein the plurality of platforms and the base layer define a forked channel extending below the base layer and between the platforms, the forked channel comprising a stem portion extending longitudinally from the midline between the first group of platforms, a medial branch extending from the stem portion through the first group of platforms to the medial perimeter of the forefoot, a lateral branch extending from the stem portion between the first group of platforms to the lateral perimeter of the forefoot, and two intermediate branches extending from the stem portion between the first group of platforms to different points on the outer perimeter between the medial branch and the lateral branch.

23. The outsole of claim 22, wherein the forefoot region comprises an open region of the base layer forward of the first group of platforms that is free of platforms and connects the stem portion of the forked channel with the medial, lateral, and intermediate branches of the forked channel.

24. The outsole of claim 22, wherein the first group of platforms comprises three pairs of platforms, each pair of platforms defining a channel segment between the pair of platforms, wherein the channel segments between the three pairs of platforms each form a different segment of the stem portion of the forked channel.

25. The athletic shoe outsole of claim 22, wherein the heel-arch region comprises a heel region and an arch region between the heel region and the forefoot region, and the arch region comprises two platforms projecting downwardly from the medial side of the base layer and at least two static traction elements extending downwardly from each of the two platforms on the medial side of the arch region.

26. The athletic shoe outsole of claim 11, wherein a lateral half of the arch region is free of traction elements.

27. The athletic shoe outsole of claim 22, wherein the plurality of platforms and the base layer further define a second forked channel extending below the base layer and between the platforms, the second forked channel comprising a transverse stem portion extending inwardly from the medial perimeter of the forefoot, a forward branch extending from the transverse stem portion to the lateral perimeter of the forefoot, and a rearward branch extending from the transverse stem portion to the lateral perimeter of the forefoot rearward of the forward branch.

28. The athletic shoe outsole of claim 27, wherein the second forked channel further comprises an intermediate branch that extends from the rearward branch to the lateral perimeter and is positioned between the forward and rearward branches;

wherein a first one of the platforms is positioned along the lateral perimeter between the rearward branch and the intermediate branch, a second one of the platforms is positioned along the lateral perimeter between the forward branch and the intermediate branch; and wherein the first one of the platforms comprises plural static traction members and the second one of the platforms is configured to mount a dynamic traction member.

* * * * *